US005778620A

United States Patent [19]

Fisher

[11] Patent Number: 5,778,620

[45] Date of Patent: Jul. 14, 1998

[54] CONSTRUCTION BLOCK

[76] Inventor: Myles Fisher, 2006 E. Mallory St., Pensacola, Fla. 32503

[21] Appl. No.: 603,460

[22] Filed: Feb. 20, 1996

[51] Int. Cl.[6] ..... E04B 5/46; E04C 1/42

[52] U.S. Cl. ..... 52/306; 52/307; 52/308; 52/204.62; 52/235; 52/588.1

[58] Field of Search ..... 52/306–308, 235, 52/574, 779, 780, 588.1, 204.61

[56] References Cited

U.S. PATENT DOCUMENTS

| | | | |
|---|---|---|---|
| 4,793,104 | 12/1988 | Hultberg et al. | 52/306 X |
| 4,891,925 | 1/1990 | Carlson et al. | 52/306 X |
| 5,033,245 | 7/1991 | Kline | 52/306 |
| 5,038,542 | 8/1991 | Kline | 52/306 |
| 5,588,271 | 12/1996 | Pitchford | 52/306 |
| 5,595,033 | 1/1997 | Frey | 52/204.62 X |

*Primary Examiner*—Carl D. Friedman
*Assistant Examiner*—W. Glenn Edwards
*Attorney, Agent, or Firm*—Peter Loffler

[57] ABSTRACT

A construction block comprises parallel faces joined by four side edges. Two side edges have outer spacing flanges while the other two side edges have inner spacing flanges. The inner flanges are received within a recess defined by the outer flanges. Hook receptacles located on the lower portion of the outer spacing flanges receive hooks located along the length of the inner spacing flanges when two blocks are interconnected, holding the two blocks firmly to each other. The interfacing flanges provide spacing support and integrity and a location for flange to flange ultrasonic spot welding. A structural bar is positionable within the recess of the inner spacing flanges.

9 Claims, 4 Drawing Sheets

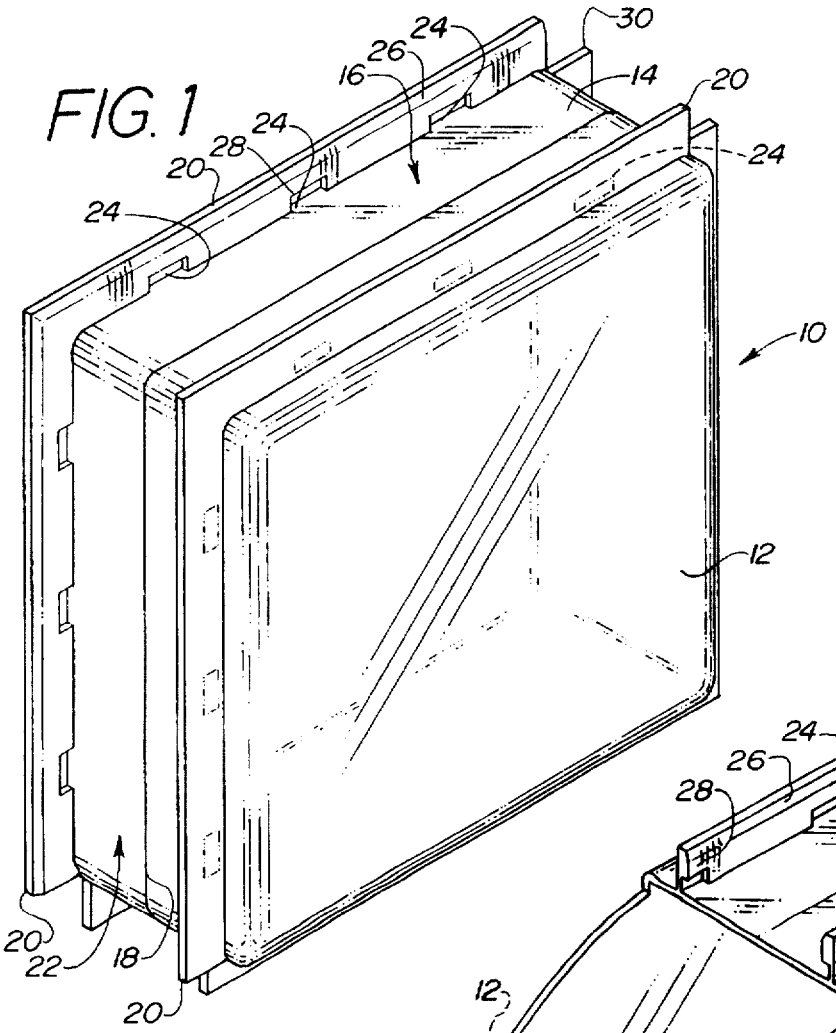
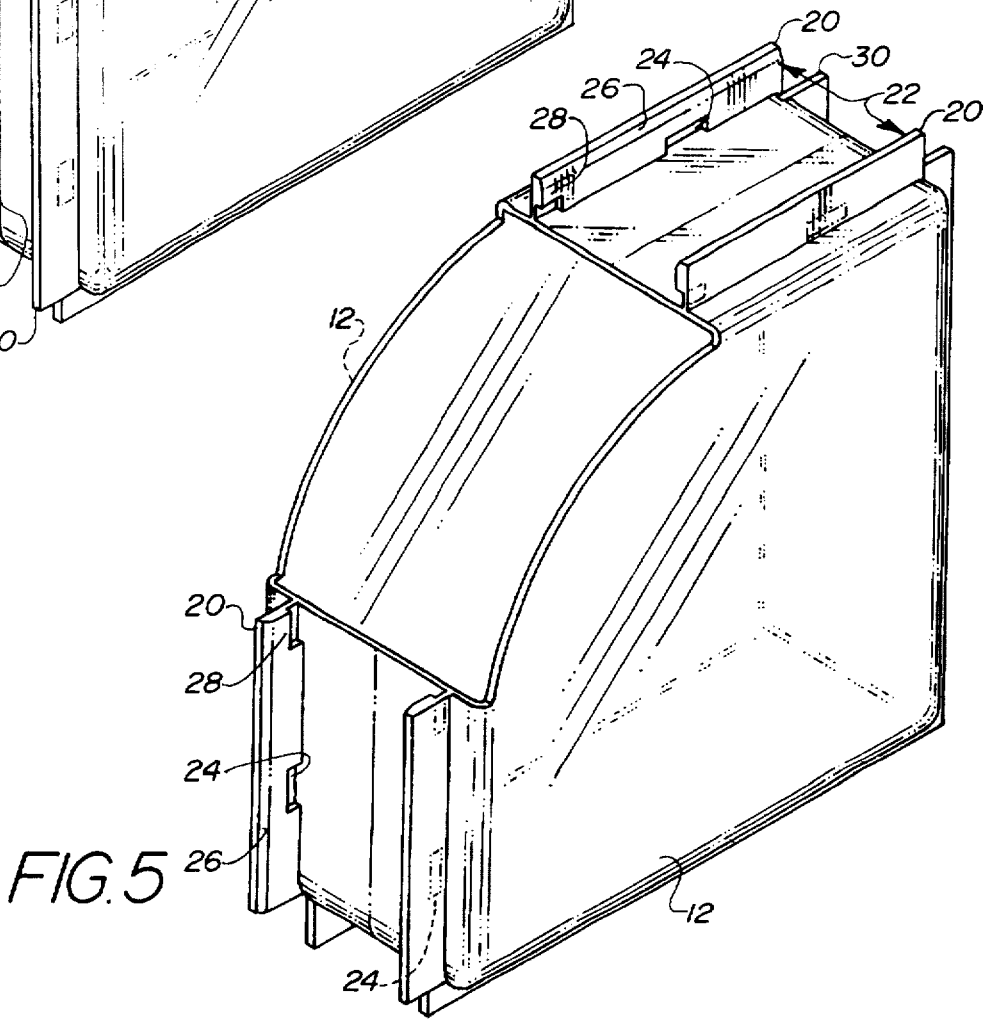
FIG. 5

CONSTRUCTION BLOCK

BACKGROUND OF THE INVENTION

1. Field of the Invention

The present invention relates to interconnecting blocks and more specifically to interconnecting blocks used to construct glass and glass-like partition walls, windows and the like.

2. Background of the Prior Art

Glass and glass-like partition walls are a regular part of modern construction. These walls, which can be either internal or external, are made from transparent or translucent glass, or more often, plastic blocks interfitted to form the wall.

The art contains numerous examples of interconnecting construction blocks, many specifically targeted for building glass and glass-like partition walls. The current preferred block for constructing partition walls is seen in U.S. Pat. No. 4,891,925 issued to Carlson et al. The Carlson block has connection means at each corner in order to join the blocks to one another. Although the Carlson device uses spacing flanges in order to assist in block alignment during wall construction, the Carlson device continues to have limitations.

The connection means on the Carlson invention require a certain amount of time to fit, thereby increasing labor time during wall construction. The corner location of the connection means reduce the tightness of the fit of the blocks to each other and increases the vulnerability of failure of block interconnection. Failure at any of the connection means will result in partition wall failure. Furthermore, the Carlson device prohibits construction of walls that have other than rectangular configurations, such as a wall or window with a sloped or curved edges Therefore, there is a need in the art for a construction block for use in window or wall partition fabrication that overcomes the above-stated limitations. Such a device must permit rapid and efficient block interconnection. Such a block must tightly and securely interconnect to other blocks and must have connection means redundancy in case of connection means failure. The block must permit construction of partition walls and windows that are not necessarily rectangular in shape.

SUMMARY OF THE INVENTION

The construction block of the present invention meets the aforementioned needs in the art. The device provides for a construction block that interconnects to another construction block almost instantaneously. The device permits part of the block to be cut away in order to permit non-rectangular-shaped partition wall construction. The failure of the connection means on the construction block of the present invention will not result in partition wall failure.

The construction block of the present invention is comprised of a generally rectangular block having a pair of parallel faces joined by four side edges. A pair of outer spacing flanges, perpendicular to the side edges and parallel and adjacent to the faces, are located on two of the four side edges, either on adjacent or opposing side edges. A pair of inner spacing flanges, perpendicular to the side edges and parallel and adjacent to the faces, are located on two of the four side edges, either on adjacent or opposing side edges. The inner spacing flanges are positioned such that when one block is fitted to another block, the inner spacing flanges are received within the recess created by the outer spacing flanges of the adjacent block with the outer side faces of the inner spacing flanges abutting the inner side faces of the outer spacing flanges of the adjacent block. Each set of flanges seats upon a side edge of the other block. The interfacing inner and outer flanges provide support for the two interconnected blocks.

One or more hook receptacles are located along the lower portion of each outer spacing flange. One or more resilient hooks, in corresponding number to the number of hook receptacles, are located along the length of the inner spacing flanges and separated from each spacing flange.

Two blocks can be positioned such that an outer spacing flange-bearing side edge faces an inner spacing flange-bearing side of the other block. Thereafter, one of the blocks is pushed into the other. The hook receptacles receive the hooks that "click" into place. One-way ramps on both the hook receptacles and the hooks assure that once the blocks are interconnected, they will not separate. Once interconnected, the top of each spacing flange abuts the side edge of the other block thereby creating a very tight, snug, and mutually supporting fit. A structural bar can be positioned between the blocks within the recess between the inner spacing flanges to create a further tight and snug interfit and to improve structural integrity of any wall or window built from the blocks.

Using the construction blocks of the present invention greatly expedites the construction of a partition wall. Once the blocks are positioned, they are merely snapped into place without the need to assemble any connection means. Block interfit is extremely tight and secure. By using interconnection means along the entire length of each block, as opposed to just the corners, redundancy exists in block interconnection and failure of one or more connection means will not result in partition wall or window failure. Furthermore, a section of the block may be removed, either a straight section or an arcuate section, permitting non-rectangular-shaped partition wall construction. Such block section removal will not result in block interconnection failure.

The construction wall of the present invention is relatively simple and straightforward to manufacture.

BRIEF DESCRIPTION OF THE DRAWINGS

FIG. 1 is a perspective view of the construction block of the present invention showing the outer spacing flanges.

FIG. 5 is a perspective view of the construction block of the present invention with a section of the block removed.

Similar reference numerals refer to similar parts throughout the several views of the drawings.

DETAILED DESCRIPTION OF THE PREFERRED EMBODIMENT

Figure 2:
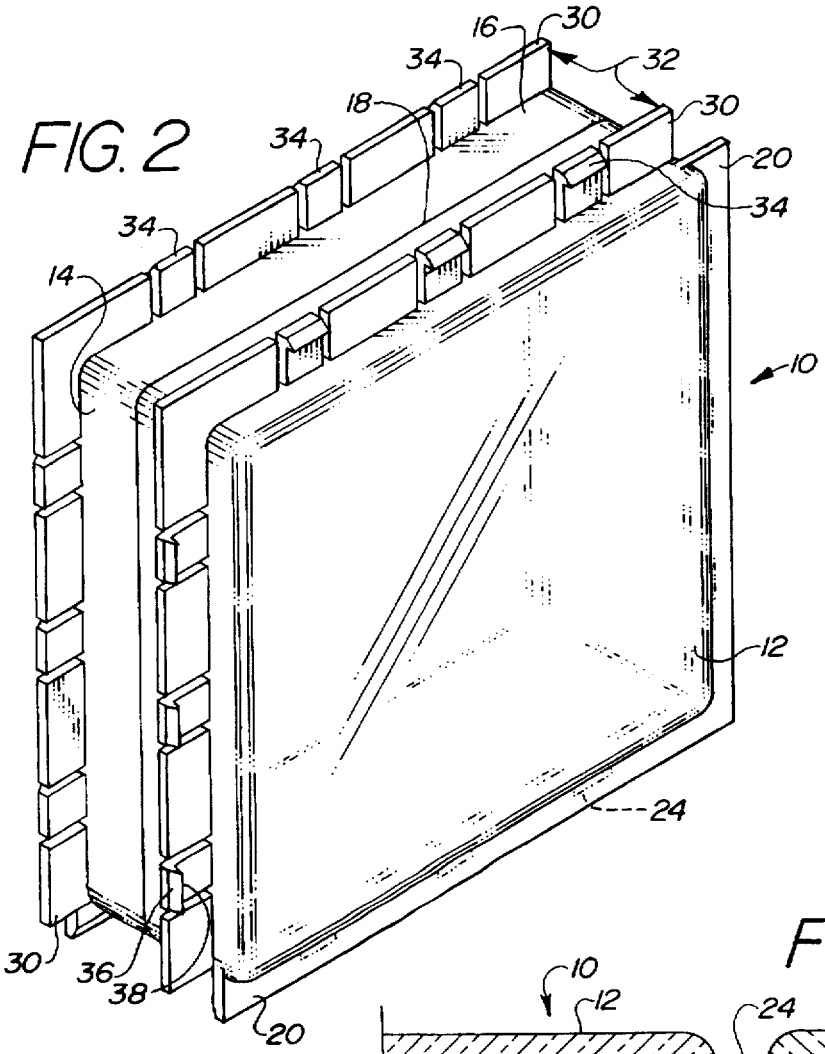
FIG. 2 is a perspective view of the construction block of the present invention showing the inner spacing flanges.
Figure 8:
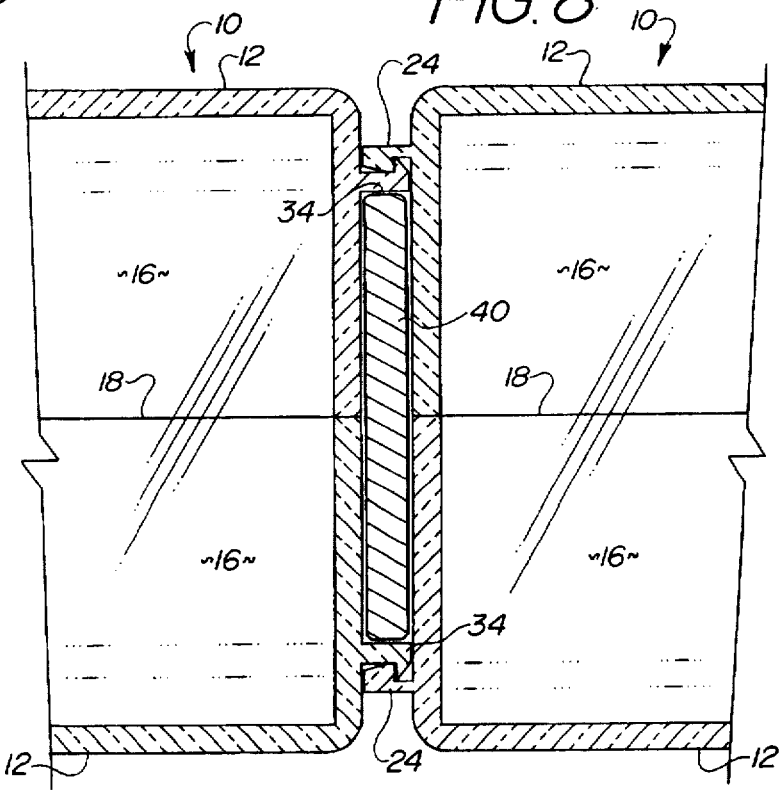
FIGS. 6–8 are cutaway views illustrating interconnection of two construction blocks of the present invention.

Referring to the drawings, it is seen that the construction block of the present invention, generally denoted by reference numeral 10, is a generally rectangular form, having a pair of parallel disposed faces 12 joined by four side edges 14. The block 10 may be formed as a single unit, or as shown, as a pair of identical halves 16 joined along seam 18 in any appropriate fashion. The block 10 may be formed from transparent or translucent plastic. Alternately, the block 10 can be opaque and furthermore, may be formed from any appropriate material. Several blocks 10 can be interconnected and built into a partition wall or a block window.

Located on two of the side edges 14 are a pair of outer spacing flanges 20 extending perpendicularly outward from the plane of the side edge 14 adjacent and parallel to each face 12. A recess 22 exists between the outer spacing flanges 20. The two side edges 14 that contain the outer spacing flanges 20 can be adjacent side edges 14 or opposing side edges 14. As seen in FIG. 1, one or more hook receptacles 24 are located along the length of each outer spacing flange 20. As seen, the hook receptacle 24 has a ramped portion 26 and a lip 28.

Figure 3:
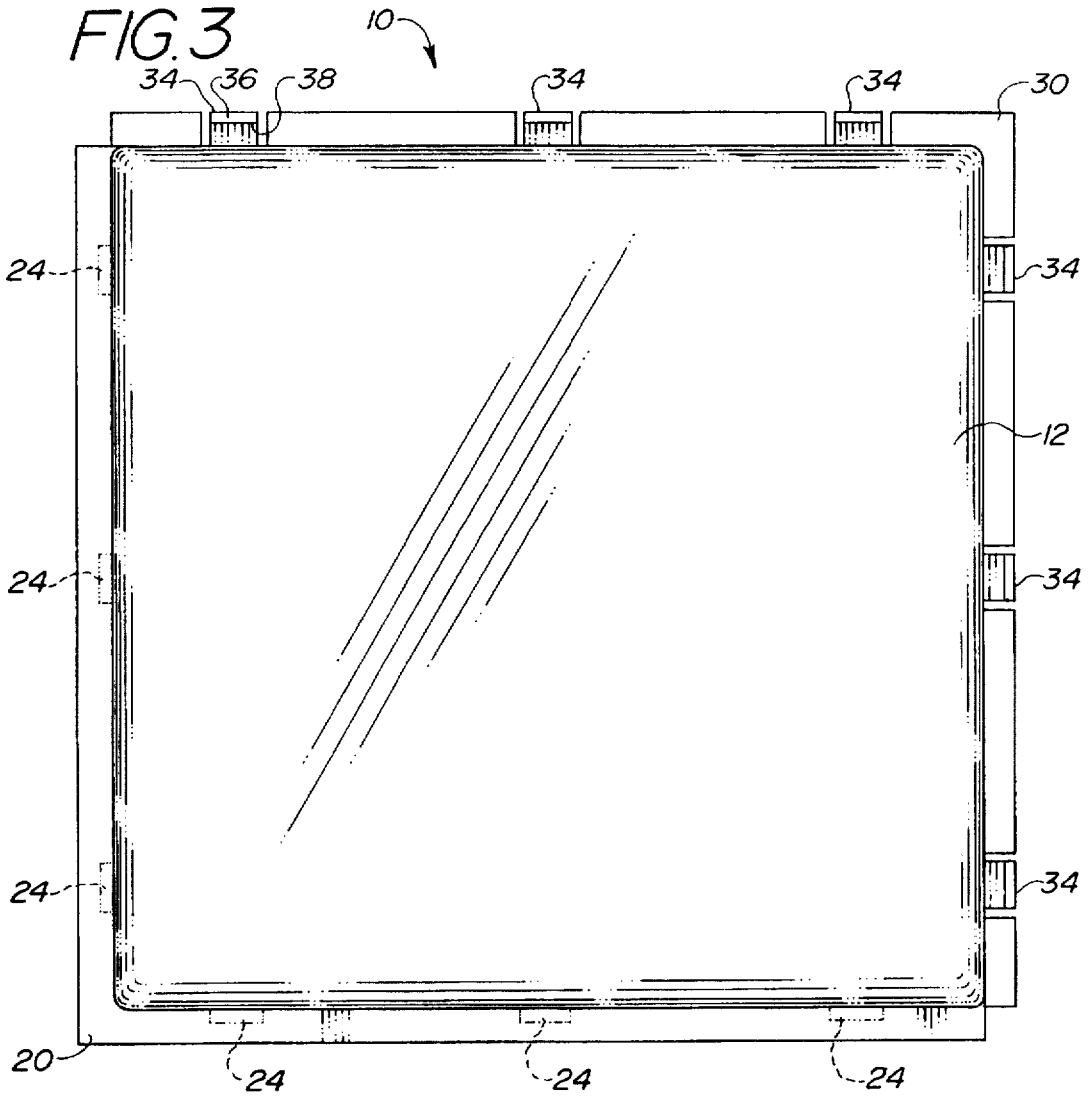
FIG. 3 is a front elevation view of the construction block of the present invention.
Figure 4:
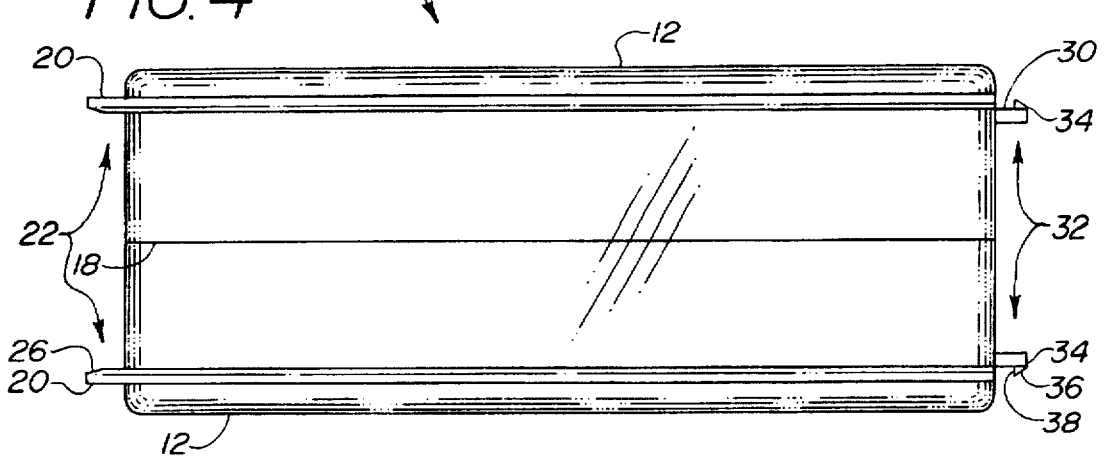
FIG. 4 is a top plan view of the construction block of the present invention.
Figure 6:
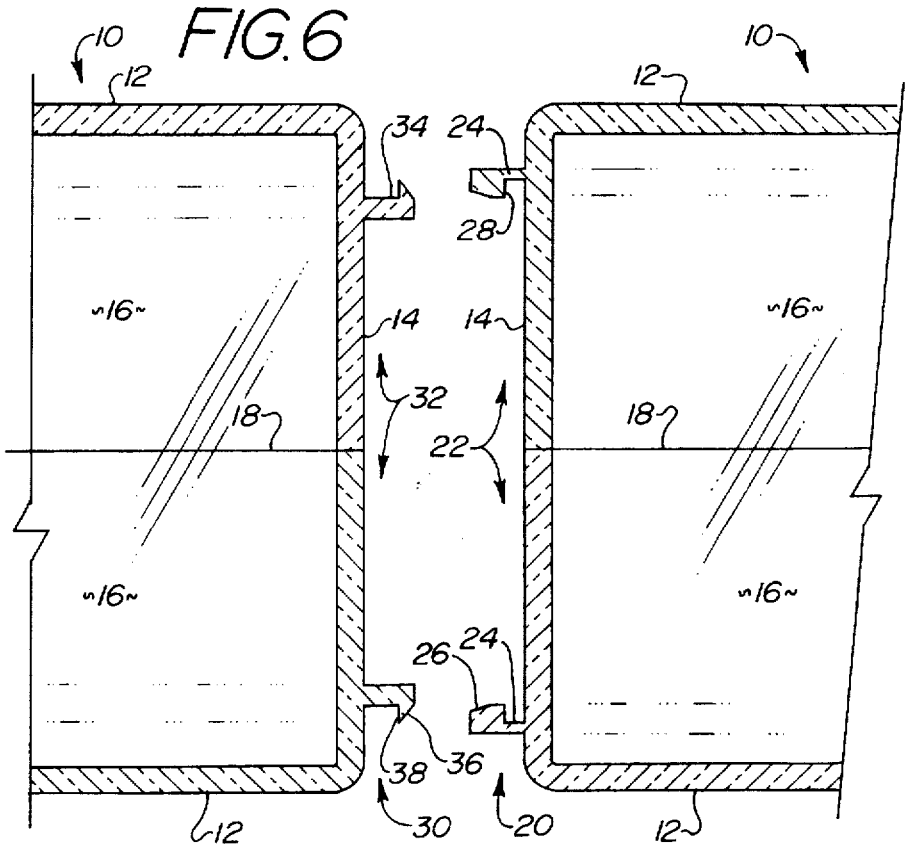
Figure 7:
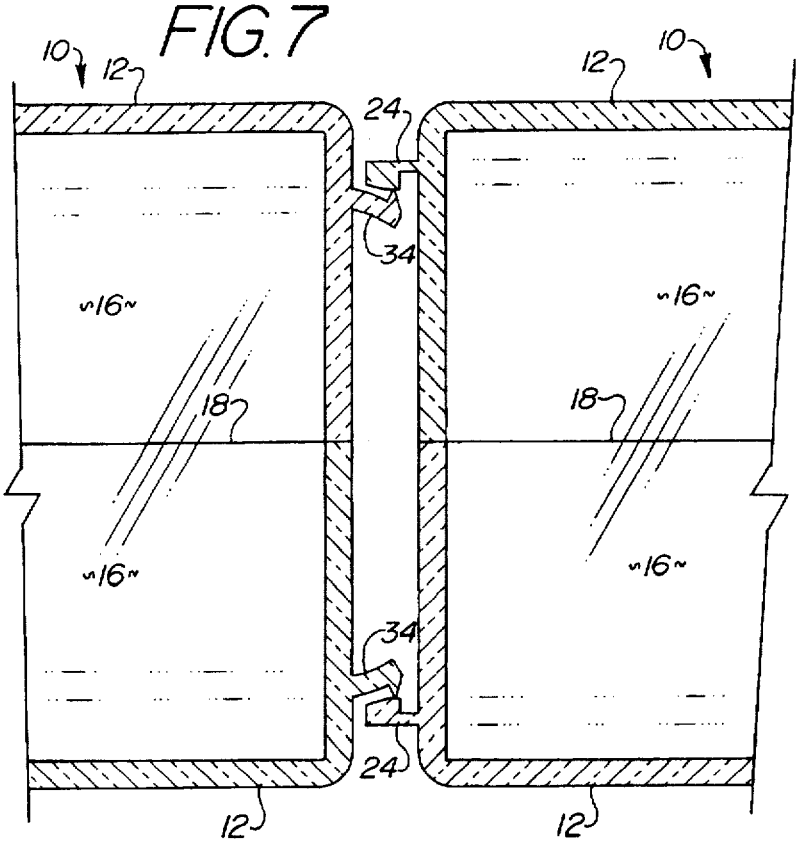

Located on two of the side edges 14 are a pair of inner spacing flanges 30 extending perpendicularly outward from the plane of the side edge 14 adjacent and parallel to each face 12. A recess 32 exists between the inner spacing flanges 30. The two side edges 14 that have the inner spacing flanges 30 can be adjacent side edges 14, if adjacent side edges 14 hold the outer spacing flanges, or opposing side edges 14, if opposing side edges 14 hold the outer spacing flanges 20. As seen in FIGS. 3 and 4, one or more hooks 34, in corresponding number to the number of hook receptacles 24 that are located on the outer spacing flanges 20 and in corresponding locations along the length of the side edges 14 relative to the locations of the hook receptacles 24, are located along the length of each inner spacing flange 30. As seen, each hook 34 has a ramped portion 36 and a lip 38. A small void area 40 separates the hooks 34 from the inner spacing flanges 30. The height of the outer spacing flanges 20, inner spacing flanges 30, and hooks 34 are all equal. The inner spacing flanges 30 are positioned closer to the central portion of their respective side edges 14 relative to the outer spacing flanges 20.

In order to interconnect two blocks 10 to one another, the blocks 10 are positioned such that a side edge 14 having inner spacing flanges 30 of one of the blocks 10, faces a side edge 14 having outer spacing flanges 20 of the other block 10. The two blocks 10 are pushed toward one another. This causes the ramped portion 36 of each hook 34 to interact with the ramped portion 26 of the corresponding hook receptacle 24. The hook 34 is formed such that it is sufficiently resilient to bend inwardly to permit the two ramped portions 26 and 36 to pass over one another. Once the ramped portions 26 and 36 pass one another, the hook 34 "clicks" into place and returns to its original position. As such, the lip 38 of the hook 34 abuts the lip 28 of the hook receptacle 24. The two lips 28 and 38 hold one another and prevent the blocks 10 from being separated from each other. The blocks 10 can separated from each other only by permanent invalidation of one of the blocks.

In this position, the tops of outer spacing flanges 20 of the first block 10 abut the side edge of the second block 10 while the tops of the inner spacing flanges 30 and hooks 34 of the second block 10 abut the side edge of the first block 10. This results in a secure and tight fit of the two blocks to each other. If desired, a structural bar 40 can be positioned within the inner spacing flange recess 32 between the blocks after interconnecting the blocks 10 resulting in an even tighter and more secure interfit.

The use of the spacing flanges assures straight and proper alignment of the blocks 10 as a partition wall is being assembled. The use of the cooperating hooks 34 and hook receptacles 24 assures a solid and sturdy interconnection of the blocks 10 that will not fail under normal conditions. Once two blocks 10 are interconnected, the overlap of each outer spacing flange 20 with its corresponding inner flanges 30 can be ultrasonically welded to one another to further secure adjacent blocks 10 to each other. The outer faces of the outer flanges 20 form a continuous grout groove.

While the invention has been particularly shown and described with reference to an embodiment thereof, it will be understood by those skilled in the art that various changes in form and detail may be made without departing from the spirit and scope of the invention.

I claim:

1. A construction block comprising:

a generally rectangular body having a pair of faces joined by a first side edge, a second side edge, a third side edge, and a fourth side edge;

outer spacing flanges extending about the first side edge and the second side edge adjacent and essentially parallel to the faces;

at least one hook receptacle located along the outer spacing flanges and facing one of the pair of faces;

inner spacing flanges extending about the third side edge and the fourth side edge adjacent and essentially parallel to the faces and where each of the inner spacing flanges lie in a different plane relative to the outer spacing flanges; and at least one hook, in corresponding number to the number of hook receptacles, located along the inner spacing flanges and facing one of the pair of faces each of the at least one hook adapted to be received within a corresponding hook receptacle of the at least one hook receptacle, when the construction block is interconnected with another of the construction block.

2. The device as in claim 1 to further include a structural bar positioned between the inner spacing flanges when the construction block is interconnected with another of the construction block.

3. The device as in claim 1 wherein the construction block is formed from translucent plastic.

4. The device as in claim 1 wherein the construction block is formed from transparent plastic.

5. The device as in claim 1 wherein each of the at least one hook receptacle has a one way ramp.

6. The device as in claim 1 wherein each of the at least one hook has a one way ramp.

7. The device as in claim 1 wherein each of the at least one hook receptacle has a one way ramp and each of the at least one hook has a one way ramp.

8. The device as in claim 1 wherein the first side edge is adjacent to the second side edge.

9. The device as in claim 1 wherein the first side edge is adjacent to the third side edge.

* * * * *